US007293810B2

(12) United States Patent
Lopoukhine et al.

(10) Patent No.: US 7,293,810 B2
(45) **Date of Patent: *Nov. 13, 2007**

(54) APPARATUS FOR COLLECTION AND POUCHING

(76) Inventors: Matthew Lopoukhine, 63 Commonwealth Rd., Watertown, MA (US) 02472; Eugene R. Komar, 3 Craig Pl., Middletown, NJ (US) 07748

( * ) Notice: Subject to any disclaimer, the term of this patent is extended or adjusted under 35 U.S.C. 154(b) by 0 days.

This patent is subject to a terminal disclaimer.

(21) Appl. No.: 11/339,965

(22) Filed: Jan. 25, 2006

(65) Prior Publication Data

US 2006/0214441 A1 Sep. 28, 2006

Related U.S. Application Data

(60) Provisional application No. 60/650,304, filed on Feb. 3, 2005, provisional application No. 60/650,295, filed on Feb. 3, 2005.

(51) Int. Cl.
*A01K 29/00* (2006.01)
*B65B 9/02* (2006.01)

(52) U.S. Cl. ..... 294/1.4; 294/86.4

(58) Field of Classification Search ..... 294/1.3–1.5, 294/86.4; 241/168; 53/553
See application file for complete search history.

(56) References Cited

U.S. PATENT DOCUMENTS

| | | | | | |
|---|---|---|---|---|---|
| 929,960 | A * | 8/1909 | Low | 19/82 |
| 1,331,872 | A * | 2/1920 | Plucker | 241/100 |
| 3,777,708 | A * | 12/1973 | Vogt | 294/1.5 |
| 4,119,337 | A * | 10/1978 | Sherhandt | 294/1.4 |
| 4,253,691 | A * | 3/1981 | Liu | 294/1.4 |
| 4,578,013 | A * | 3/1986 | Barillec et al. | 294/1.1 |
| 4,765,666 | A * | 8/1988 | Parks | 294/1.4 |
| 5,303,910 | A * | 4/1994 | McGill et al. | 271/21 |
| 5,619,915 | A * | 4/1997 | Wagner et al. | 100/266 |
| 6,554,337 | B2 * | 4/2003 | Kazerooni et al. | 294/1.1 |
| 7,077,172 | B2 * | 7/2006 | Perkitny et al. | 294/1.3 |
| 2006/0218886 | A1 * | 10/2006 | Lopoukhine et al. | 53/550 |

FOREIGN PATENT DOCUMENTS

| | | | |
|---|---|---|---|
| DE | 3129424 | * 2/1983 | |
| FR | 2631212 | * 11/1989 | 291/1.3 |

* cited by examiner

*Primary Examiner*—Saul Rodriguez
*Assistant Examiner*—Paul T Chin

(57) ABSTRACT

A sanitary refuse collecting and pouching device having an actuator handle and a housing unit that can be configured to have a movement mechanism, material shaft rollers for dispensing replaceable collection pouch material, formation rollers, and a cutting unit. The movement mechanism drives the formation rollers causing the refuse to be enveloped and sealed in the collection pouch material. The cutting unit thereafter severs the sealed pouch, which can be stored in the housing unit until disposed.

16 Claims, 9 Drawing Sheets

APPARATUS FOR COLLECTION AND POUCHING

CROSS-REFERENCE TO RELATED APPLICATIONS

The present application claims priority to U.S. Provisional Patent Application Ser. No. 60/650,304 entitled APPARATUS FOR COLLECTING AND POUCHING by Matthew Lopoukhine and Eugene R. Komar, filed Feb. 3, 2005, the entirety of which is hereby specifically incorporated by reference for all it discloses and teaches. The present application also claims priority to U.S. Provisional Patent Application Ser. No. 60/650,295 entitled APPARATUS FOR PACKAGING AND SEALING by Matthew Lopoukhine and Eugene R. Komar, filed Feb. 3, 2005, the entirety of which is hereby specifically incorporated by reference for all it discloses and teaches.

FIELD OF INVENTION

The invention relates to an apparatus for allowing hands-free collection and disposal of objects or waste, including pet waste, by sweeping or grasping the object or waste, enveloping the object or waste in material and thereafter sealing the enveloped waste to form a sealed pouch. The sealed pouch can be stored within the apparatus until otherwise discarded.

STATEMENT AS TO RIGHT TO INVENTIONS MADE UNDER FEDERAL SPONSORED RESEARCH AND DEVELOPMENT

None

BACKGROUND OF THE INVENTION

Our population is increasingly being exposed to health risks. People can spread and contract serious illnesses by merely failing to wash their hands after touching seemingly innocuous items such as grocery goods, and they can develop life threatening diseases by picking up and handling improperly disposed waste. Moreover, viruses that were once thought to be confined to animals are infecting humans who come in contact with the sick animal or its waste. Public concern over sanitation is accordingly escalating and people are consistently adopting more stringent sanitary practices. This is especially true when they are picking up refuse or their pet's droppings, as they understand that direct or even indirect contact with the object could have serious health implications.

An extensive market exists for the collection of refuse and pet droppings. Common tools such as shovels and poker-sticks continue to be effective in some instances, but more modem devices are increasing in popularity. Some of the more well known and effective modem waste removal and pet "pooper scoopers" have a shaft with an actuating device that is used to clamp down scoops or shovels. These devices generally require the user to attach a bag in or around the scoops prior to picking up the targeted object. Variations of such products can be seen in U.S. Pat. Nos. 3,733,098, 4,056,278, 4,148,510, 4,200,319, 5,056,842, 5,326,143, and 5,335,952.

But despite the ingenuity of the prior art, a user is inevitably required to have some contact with the scoop or shovel when unloading the packaged waste or when reloading the new bag or cartridge. For instance, even if a disposable bag is placed over a device's scoop or shovel, the bag fits awkwardly and when the shovels or scoops are actuated, the user often needs to touch the bag to ensure the entire object is enclosed within it or that it is sealed. Still other devices that may or may not employ a bag often require the user to clean the scoops or shovels every time the device is used.

BRIEF SUMMARY OF INVENTION

The disclosed apparatus permits a user to collect, seal, and dispose of refuse, including pet waste, without any user contact before, during or after its use. Unlike known art, the disclosed apparatus integrate rolls of sanitary pouch material that envelopes and seals the enclosed waste, ensuring no germs or odors leak. The apparatus can have an actuator handle, a housing unit connected to the actuator handle, material rollers for dispensing collection material, a movement mechanism, actuated via the actuator handle, for moving formation rollers for facilitating the collection and enveloping of the object in the collection material to form a sealed pouch, and at least one cutting unit for severing the sealed pouch. The housing unit can also include an accessible storage compartment for storing the sealed pouches. A user would place the device over the refuse and press down on the top of the actuator handle. The handle would drive an internal rod that would transfer the movement to a movement mechanism contained inside the housing unit. The movement mechanism would in turn drive the formation rollers contained in the housing unit to turn each to turn towards each other. The turning of the formation rollers pulls the collection material off the material rollers contained in the housing unit allowing two separate sleeves of material to envelope the waste. Brushes and bridges on the formation rollers assist in sweeping the refuse into the collection material as it passes through the formation rollers. While passing through the formation rollers, the material is sealed, forming a pouch that is separated from the two rolls of collection material via a cutting blade on the formation roller. The sealed and separated pouch follows a guide mechanism towards a storage compartment contained in the housing unit where the pouch is stored until it is emptied via a side door on the housing unit.

DESCRIPTION OF PREFERRED EMBODIMENTS

Figure 1:
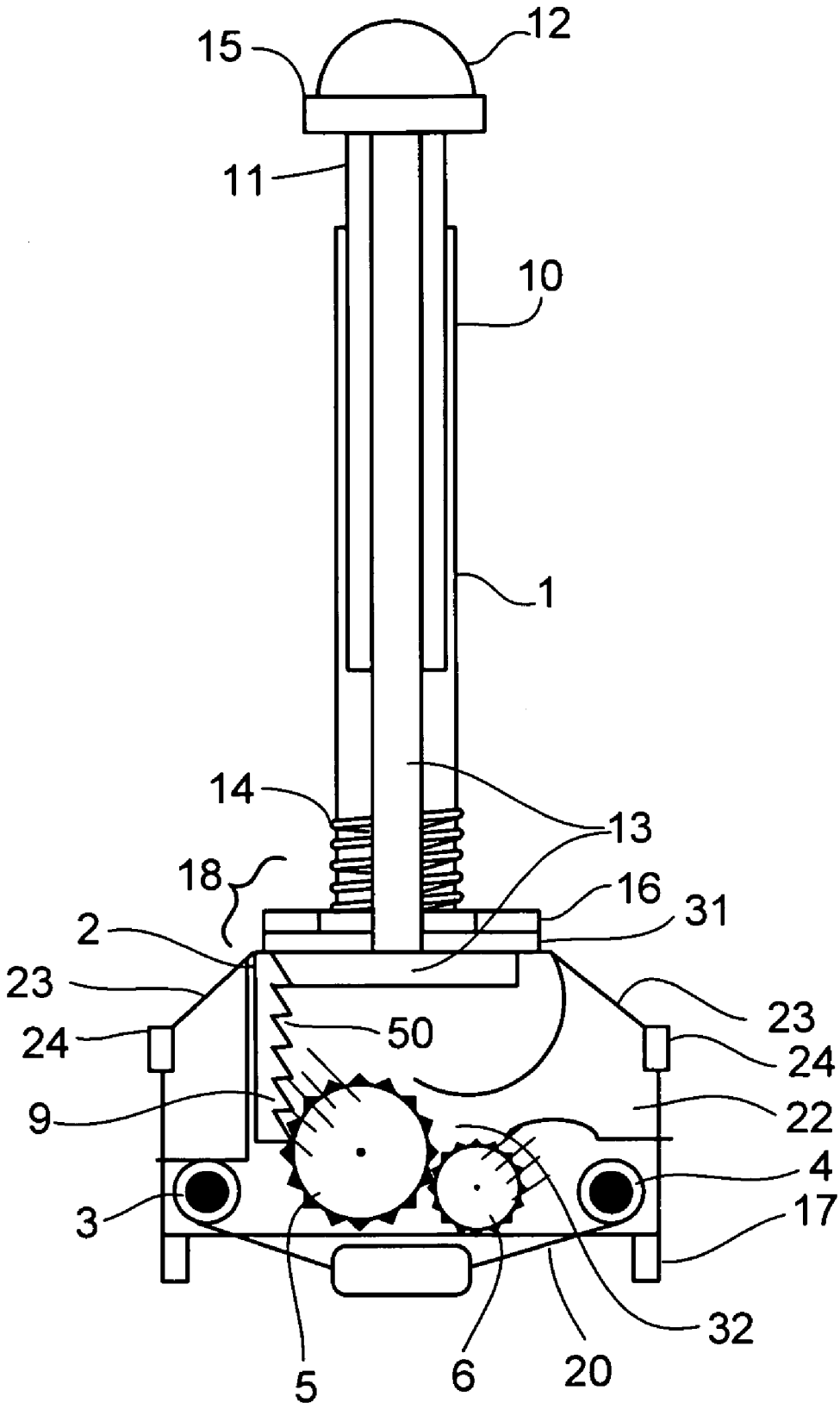
FIG. 1 is a cut-away view of a non-motorized implementation of the apparatus in its open position.

While the disclosed apparatus is susceptible to numerous implementations, there is shown in the drawings and herein described in further detail, exemplary implementations, with the understanding that the present disclosure is to be considered as illustrative of the principles of the apparatus and not intended to limit the invention to the exemplary embodiments shown and described.

Figure 2:
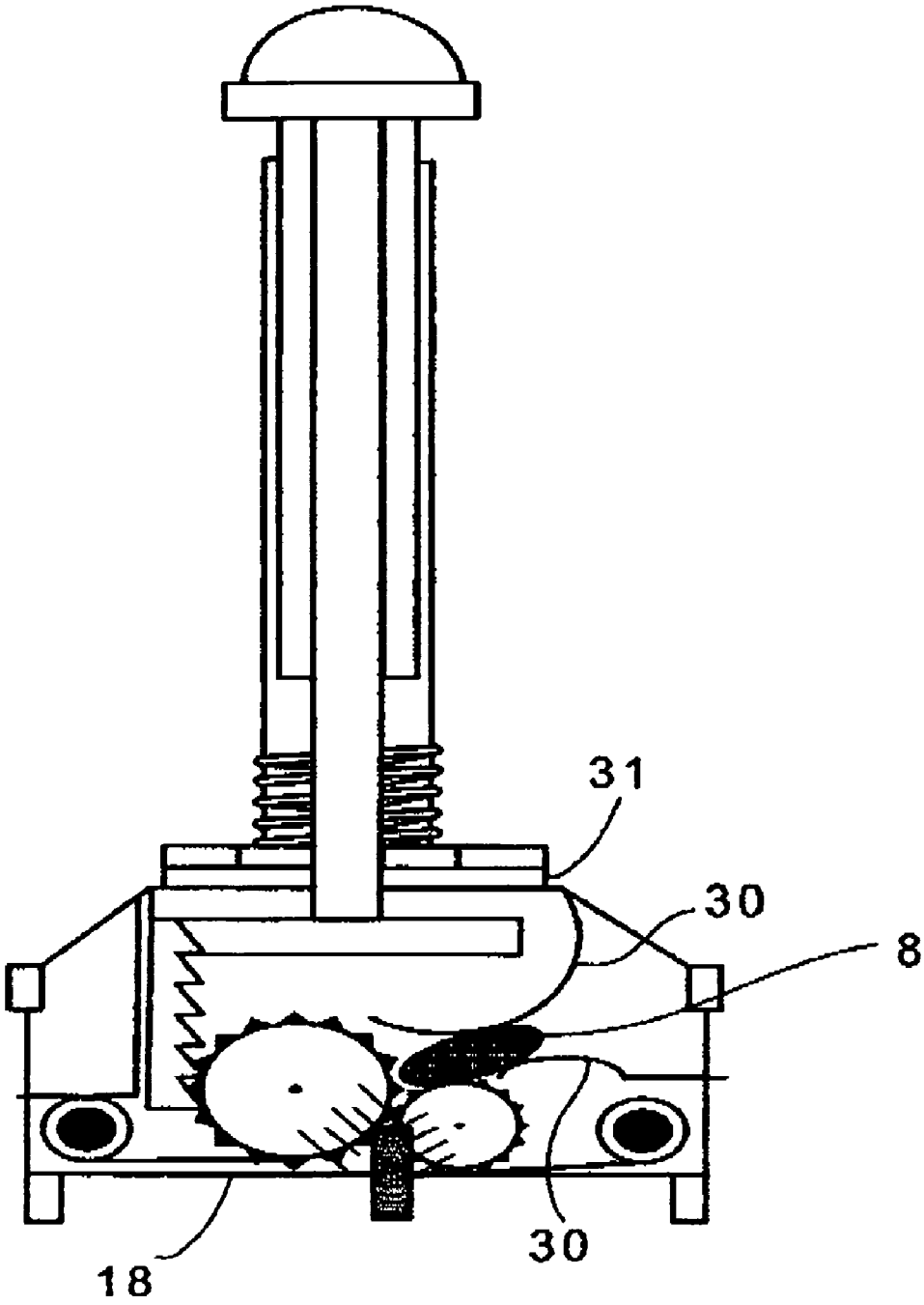
FIG. 2 is a cut-away view of a non-motorized implementation of the apparatus in its intermediate position.
Figure 3:
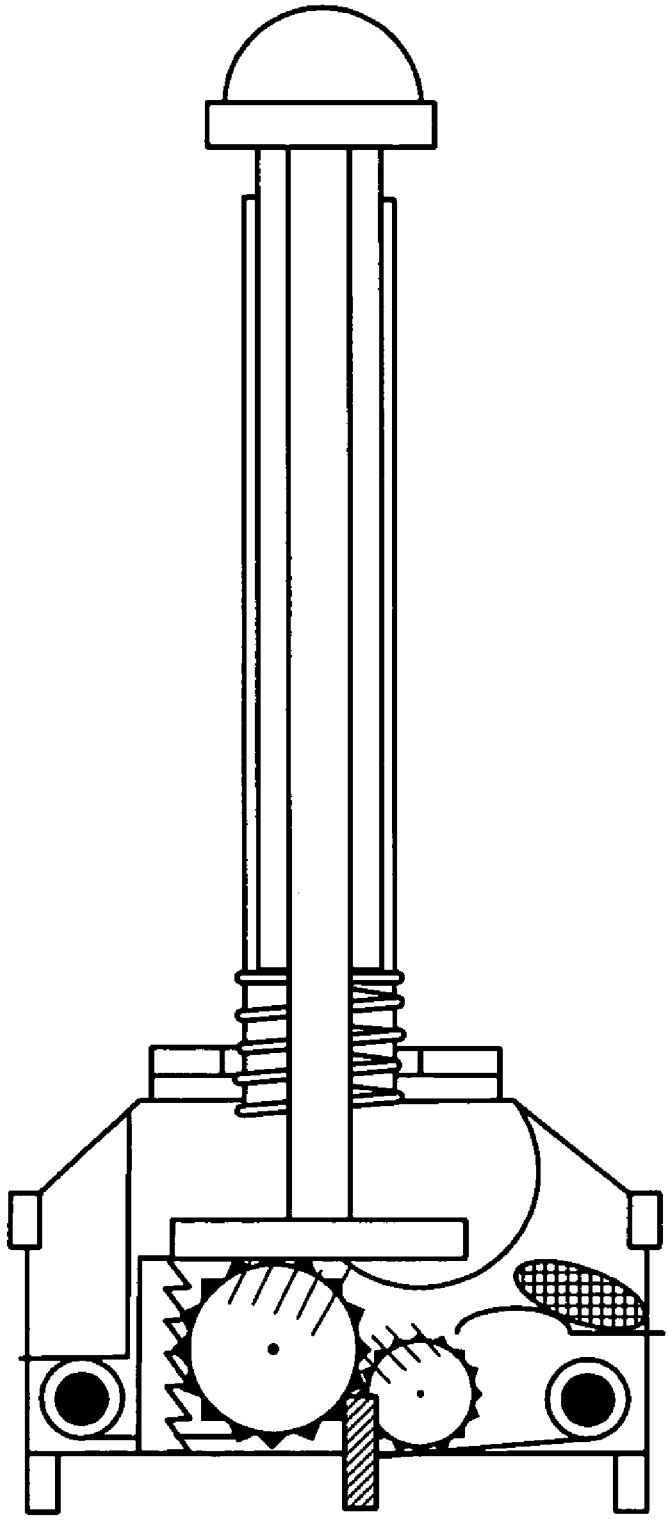
FIG. 3 is cut-away view of a non-motorized implementation of the apparatus in its closed position.

FIGS. 1 through 3 illustrate an implementation of the apparatus comprising an actuator handle 1 and a housing unit 2. The actuator handle 1 is designed to allow activation of the apparatus through the collection cycles of FIGS. 1 through 3 and can employ various means for accomplishing this purpose. The actuator handle 1 illustrated in FIGS. 1 though 3, can have a tubular shaft 10 that may be designed to have flanges 16 on its bottom end. A tubular column 11 can be concentrically and slidably positioned within the shaft 10. The column 11 can be shorter than the shaft 10 to allow space for an internal biasing mechanism 14, such as a spring, which is positioned at the bottom column 11. The biasing mechanism 14, allows the column 11 to return to its open position, as depicted in FIG. 1, after being depressed to its closed position, as depicted in FIG. 3. The biasing mechanism 14 can, of course, be positioned elsewhere to accomplish the same purpose. The top portion of the column 11 can have a grasping mechanism 12, such as a knob. An upside down t-shaped rod 13 can be concentrically positioned within the column 11 and can extend beyond the flanges 16 of the shaft 10 and into the housing unit 2. The actuator handle 1 can also incorporate a lock mechanism 15 to lock the apparatus in its open, closed or intermediate positions.

The housing unit 2 can house the material rollers 3 and 4, formation rollers 5 and 6, the cutting unit 7 and the movement mechanism 9, all of which work in conjunction, as is more fully explained below, to pick up the desired object or waste and form and store the sealed collecting pouch 8. The housing unit 2 can have one or more storage areas 22. Each storage area 22 can have a corresponding access opening and door 23 and each door 23 can have a grasping device 24. These storage areas 22 can be used to store sealed collection pouches 8 or spare rolls of collection pouch material 20. The housing unit, 2 can also employ feet 17 to displace the apparatus from the ground or underlying surface. The feet 17 can be stationary or retractable (inwardly or outwardly). If retractable, the feet 17 can be attached to the housing unit hingedly or by other similar means.

Figure 6:
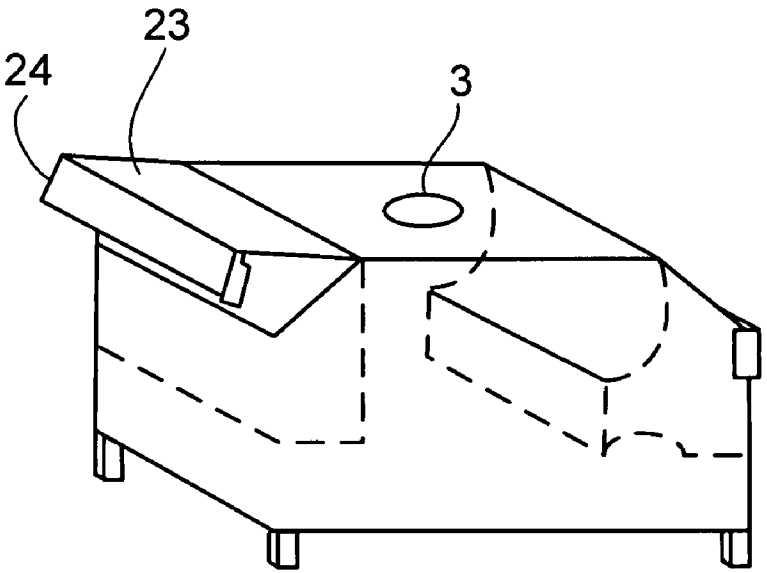
FIG. 6 is a detailed view of one implementation of the exterior view of the housing unit.
Figure 6:
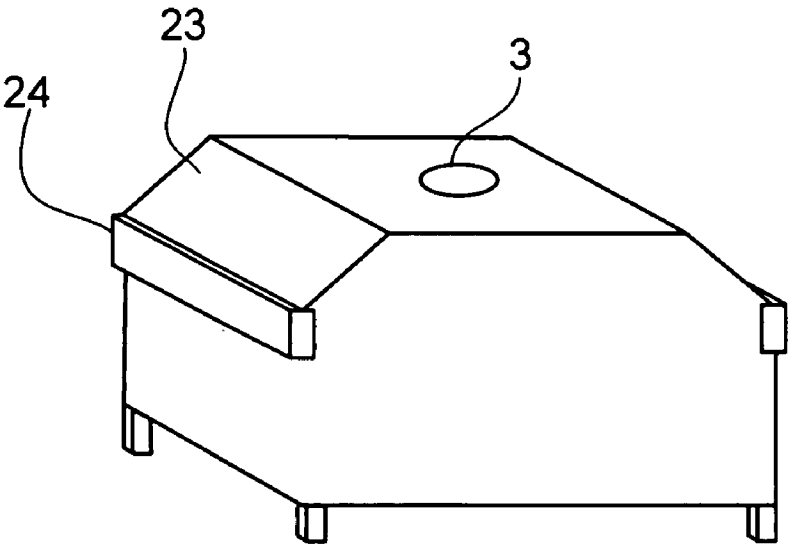

The housing unit 2 can have a bottom end that permits access to the waste to be collected and a top end that is attached or otherwise connected (directly or indirectly) to the bottom of the tubular column 11 creating a neck 18. The neck 18 can be designed to allow flexibility between the actuating handle 1 and the housing unit 2. For example, a flexible mechanism, such as a rubber ring 31, can be incorporated between the housing unit 2 and the tubular column 11. The top end of the housing unit 2, as illustrated in FIG. 6, can also have an opening 3 for the rod 13 to extend into the housing unit 2.

One or more material shaft rollers 3 and 4 facilitate the dispensing of the replaceable collection pouch material 20 and can be further configured to dispense the material 20 selectively, e.g., only once a certain tension point is created. If at least two shaft rollers 3 and 4 are employed, they can be positioned on the opposite lower sides of the housing unit 2 or at other various positions.

The collection pouch material 20, generally shaped like a continuous strip of tape or film, can be made solely of, or a combination of, paper, plastic, fabric or some other similar material or substance and is designed to envelope the object or waste to be collected and to form a sealed pouch 8. The pouch material 20 can be wound on cardboard cylinders, much like athletic or packing tape, which are designed to rotatably ride on the material shaft rollers 3 and 4. Configuring the material on such cylinders allows a user to replace the rolls of pouch material as needed. The side of the collection pouch material 20 facing towards the bottom end 18 of the housing 2 can be coated completely or in part with an adhesive substance. The adhesive substance assists in grasping the waste and also provides the necessary adhesion for sealing the pouch 8, and permits the material 20 to be continuously fed even after the pouch is formed and severed, as is further discussed below. Alternatively, the pouch material 20 may be designed to have corresponding ridges that interlock and seal the pouch 8. Other configurations of the pouch material 20 may also be employed to accomplish the foregoing.

Figure 4:
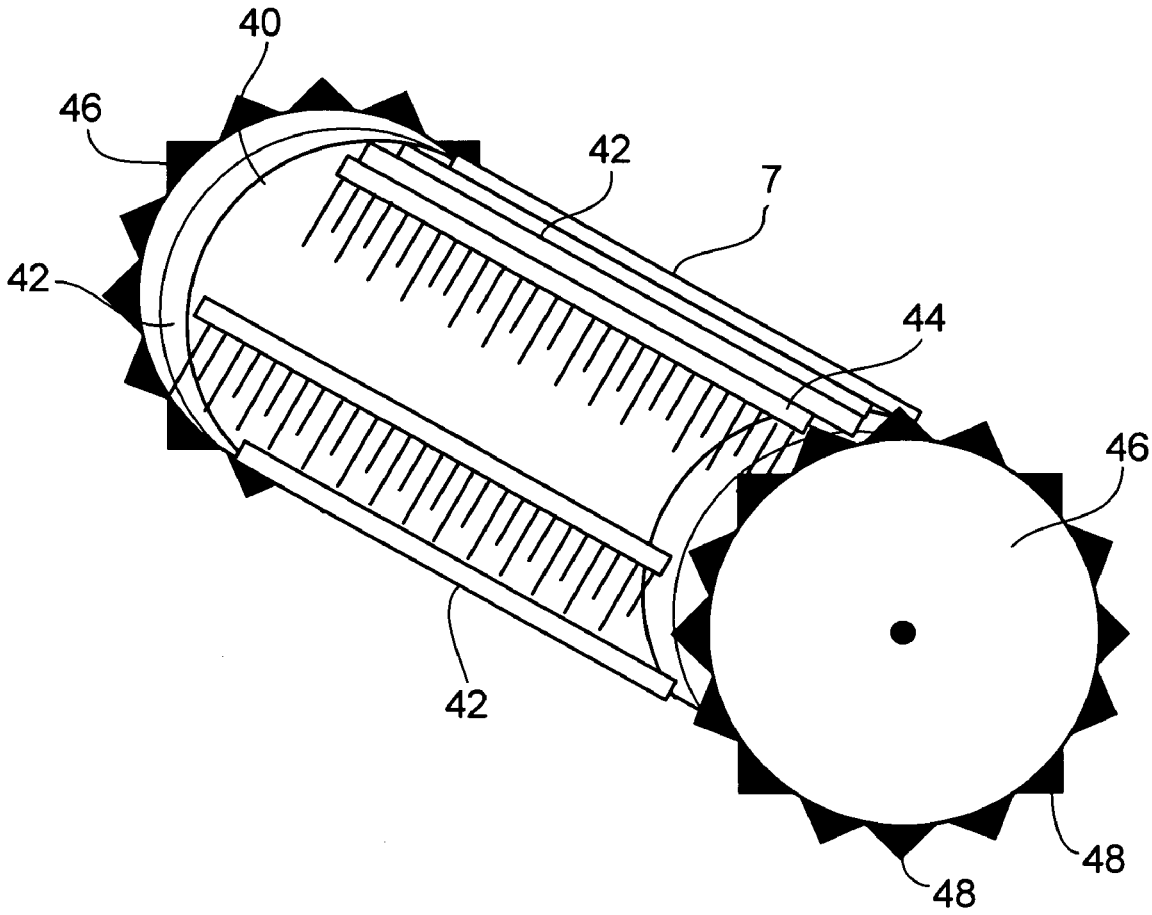
FIG. 4 is a detailed view of a formation roller.
Figure 5:
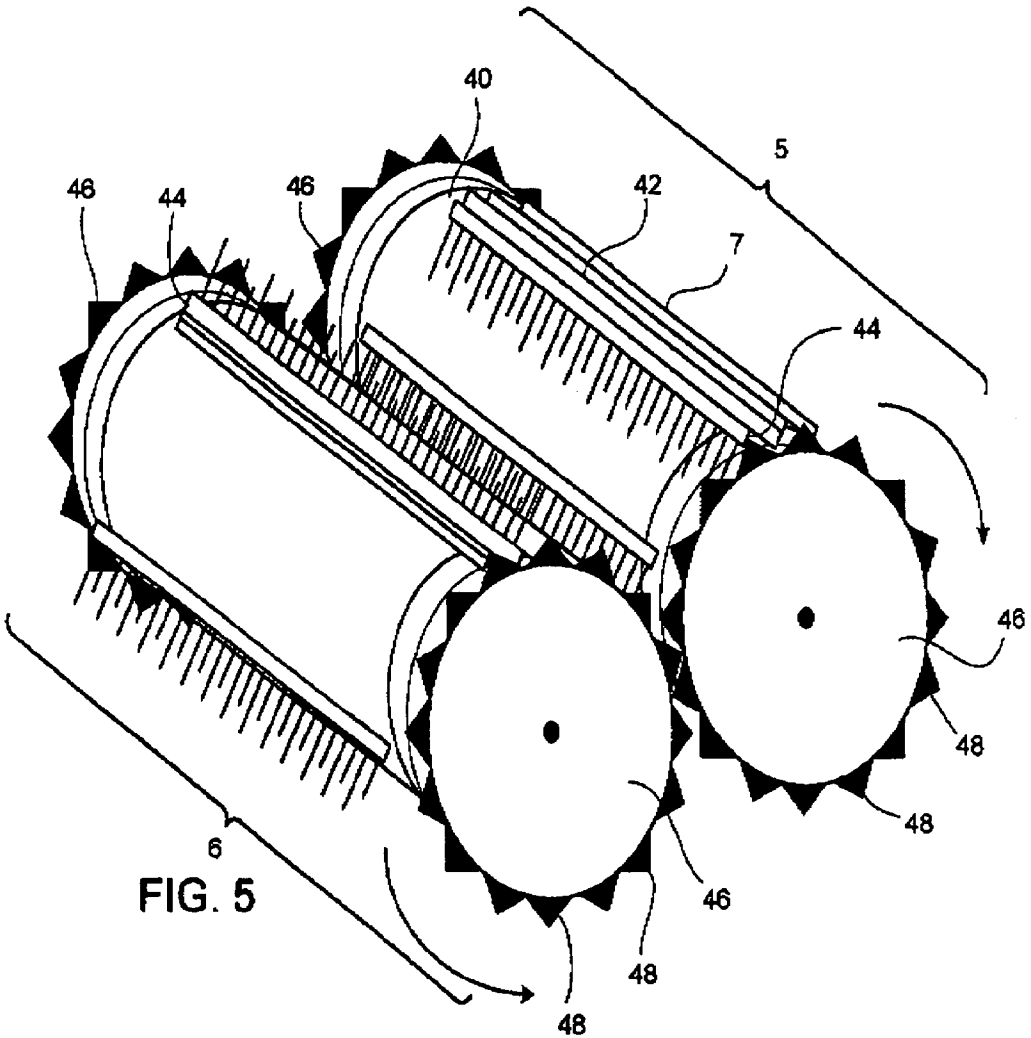
FIG. 5 is a detailed view of two formation rollers engaging one another.

A primary and secondary formation roller 5 and 6, respectively, assist in forming the sealed pouch 8. As seen in FIGS. 4 and 5, the rollers 5 and 6 can be cylindrical in shape. Although the primary formation roller 5 of FIG. 1 is depicted as being larger than the secondary formation roller 6, the size, shape and dimensions of the rollers 5 and 6 can vary, and can even be of identical shape and size. The opposite ends 46 of the rollers 5 and 6 can have engagement mechanisms 48, such as grooves, serrations or teeth, like a gear, to permit the rollers to engage one another, as well as the movement mechanism 9. The cylindrical face of either or both rollers 5 and 6 has one or more cavities 40 for allowing waste, enveloped by the collecting pouch material 20, to pass in between them. A formation bridge or bridges 42 can be used to press the material together as the enveloped waste passes through the cavities 40. Formation bridges 42 can run along or near the top, bottom and sides of the cavities 40. As the rollers 5 and 6 rotate in their respective opposite directions, as shown by the arrows in FIG. 5, their respective formation bridges 42 align so that when the enveloped waste passes through the cavity 40, the formation bridges 42 press the pouch material 20 together, causing anterior, posterior and side seals along the pouch. The number of rotations the rollers 5 and 6 make in order to align the formation bridges 42 will depend on their size and shape. For example, if the primary formation roller 5 is larger than the secondary rollers 6, as illustrated in FIG. 1, then the secondary roller 6 may rotate twice to every one rotation of the primary roller 5. Alternatively, if the rollers 5 and 6 are of equal size, as illustrated in FIG. 5, then the rollers 5 and 6 may only be required to each rotate once to align the formation bridges 42. Other variations of this rotation process may also be employed and the number of formation bridges 42 may also vary depending on the sizes of the formation rollers 5 and 6. A locking mechanism (not shown) can also be employed on either or both of the formation rollers 5 and 6 to limit them to move only in one direction.

Formation of the sealed pouch 8 may also be accomplished by employing only one formation roller 5 or 6. For example, a plate or scoop 50 (not shown) can be positioned opposite to the sole formation roller 5 or 6, and can compliment the formation roller 5 and 6 to allow the enveloped object to pass through while forming the sealed pouch. In fact, the plate or scoop 50 can extend beyond the bottom of the housing unit to facilitate a dust-shovel/broom type action. Further still, more than two formation rollers can be employed to form the sealed pouch.

The apparatus can also employ grasping mechanisms, such as flaps or brushes 44, for assisting in grasping and sweeping the object or waste. As illustrated in FIGS. 5 and 6, the brushes 44 can be attached to the rollers 5 and 6. Alternatively, however, the brushes 44 can be employed on separate rollers or devices (not shown) that engage the formation rollers 5 and 6 or movement mechanism 9 and facilitate grasping and sweeping motions of the brushes.

The cutting unit 7 is designed to sever the sealed pouch 8. The cutting unit can be a blade that runs generally parallel to the bottom formation bridge 42 of one or more cavities 40 of either formation roller 5 and 6. In FIG. 5, the cutting unit 7 runs parallel to the bottom formation bridge 42 of the cavity 40 (not shown) opposite to the one depicted. Accordingly, when the corresponding bottom formation bridges 42 of the rollers 5 and 6 form the posterior and final seal of the collection pouch 8, the cutting unit 7 engages an area of the opposite roller and severs the pouch 8 as the formation rollers 5 and 6 continue to rotate. Although the cutting unit 7 can be employed on either formation roller 5 and 6, it on also be a separate unit attached to the housing unit 2 and positioned to sever the sealed collection pouch 8 after it passes through the formation rollers 5 and 6. Of course, more than one or different variations of the cutting unit 7 can be employed to sever the pouch.

The movement mechanism 9 is designed to engage and move the formation rollers 5 and 6. As illustrated in FIGS. 1 through 3, the movement mechanism 9 can be attached or formed to the bottom of the rod 13. The movement mechanism can have at least one, but in this implementation, two prongs, 67 and 68, which are perpendicularly positioned to the upside down t-shaped rod 13. Prongs 67 and 68 can be teethed, grooved or serrated to engage and drive the formation rollers 5 and 6 when the movement mechanism 9 is depressed downwardly.

FIGS. 1 through 3 illustrate a collection cycle, i.e., sweeping and grasping the waste and forming and storing the sealed pouch 8. In particular, FIG. 1 shows the apparatus in its inactive, open position. While in this open position, the apparatus is ready to pick up the waste or object, and the material 20 is held taught between the roller shafts 3 and 4 and the bottom formation bridges 42 of the rollers 5 and 6. A user can position the bottom end of the housing unit 2 over the waste to be collected and preferably within the vicinity of the formation rollers 5 and 6 or brushes 44. When the user depresses the column 11, the movement mechanism 9 is driven in a downward direction, driving the major formation roller 5 in a counterclockwise direction, which in turn engages the minor formation roller 6, causing it to turn in the opposite, clockwise direction. As the rollers 5 and 6 rotate in opposite directions, the brushes of the respective rollers also move in outwardly, opposite directions, causing the brushes 44 to move in an circular converging sweeping and grasping motion. When the brushes 44 contact the interior side of the pouch material 20, the sweeping and grasping motion cause the collection material 20 to envelope the waste as the brushes 44 converge.

As the column 11 continues to be depressed, as illustrated in FIG. 2, the formation rollers 5 and 6 continue to rotate and the brushes 44, now moving in an upwardly direction, guide the enveloped waste between the rollers' cavities 40 (See FIG. 4). When the rollers 5 and 6 rotate to where the top formation bridges 42 of the rollers' cavities 40 engage, the anterior seal of the pouch is formed. As the rollers 5 and 6 continue to rotate, and the side formation bridges 42 engage, the sides of the pouch are sealed. Finally, when the bottom formation bridges 42 engage as the formation rollers 5 and 6 continue to rotate, the posterior seal of the pouch is formed and thereafter severed by the cutting unit 7. This same process can be accomplished by employing one formation roller 5 or 6 and a complimentary plate or scoop 50.

After the sealed pouch 8 is severed, it slides along or within a guide mechanism, such as a top and/or bottom tongue or lip 30 that terminates at the opening of the storage compartment 22, where the pouch is deposited until removed. The brushes 44 may assist in moving the sealed pouch 8 along the guidance mechanism 30, or the guidance mechanism 30 may be designed at a downwardly sloping angle to facilitate movement of the sealed pouch 8 into the storage compartment 22.

Even though the sealed pouch 8 has been severed, the adhesive sides of the pouch material 20 have been pressed together during the pouch formation process, forming a tab-like configuration 32 in the material 20, allowing it to retain a continuous strip form. The tab-like configuration 32 is formed when the portion of the pouch material 20 just behind the severed pouch 8 is sealed together by the formation bridges 42 of the rollers 5 and 6. Accordingly, when the user releases the column 11, and the apparatus returns to its open position, as illustrated in FIG. 1, the tab-like configuration 32 remains pinched between the bottom formation bridges 42 of the rollers 5 and 6, keeping the pouch material 20 taught and readying the apparatus for its next collection cycle. When a user loads new material pouch cartridges, he can manually create the tab-like configuration and feed it into the formation rollers 5 and 6 to ready the apparatus, or he can run the apparatus through a collection cycle as shown in FIGS. 1 through 3. There are of course other various ways to ready the apparatus after first loading the pouch material cartridges. Moreover, the tab-like configuration 32 can be formed by interlocking ridges or other similar mechanisms in the pouch material 20, and the pinching action described can alternately be accomplished by employing only one formation roller 5 or 6 and a complimenting scoop or plate 50.

Figure 7:
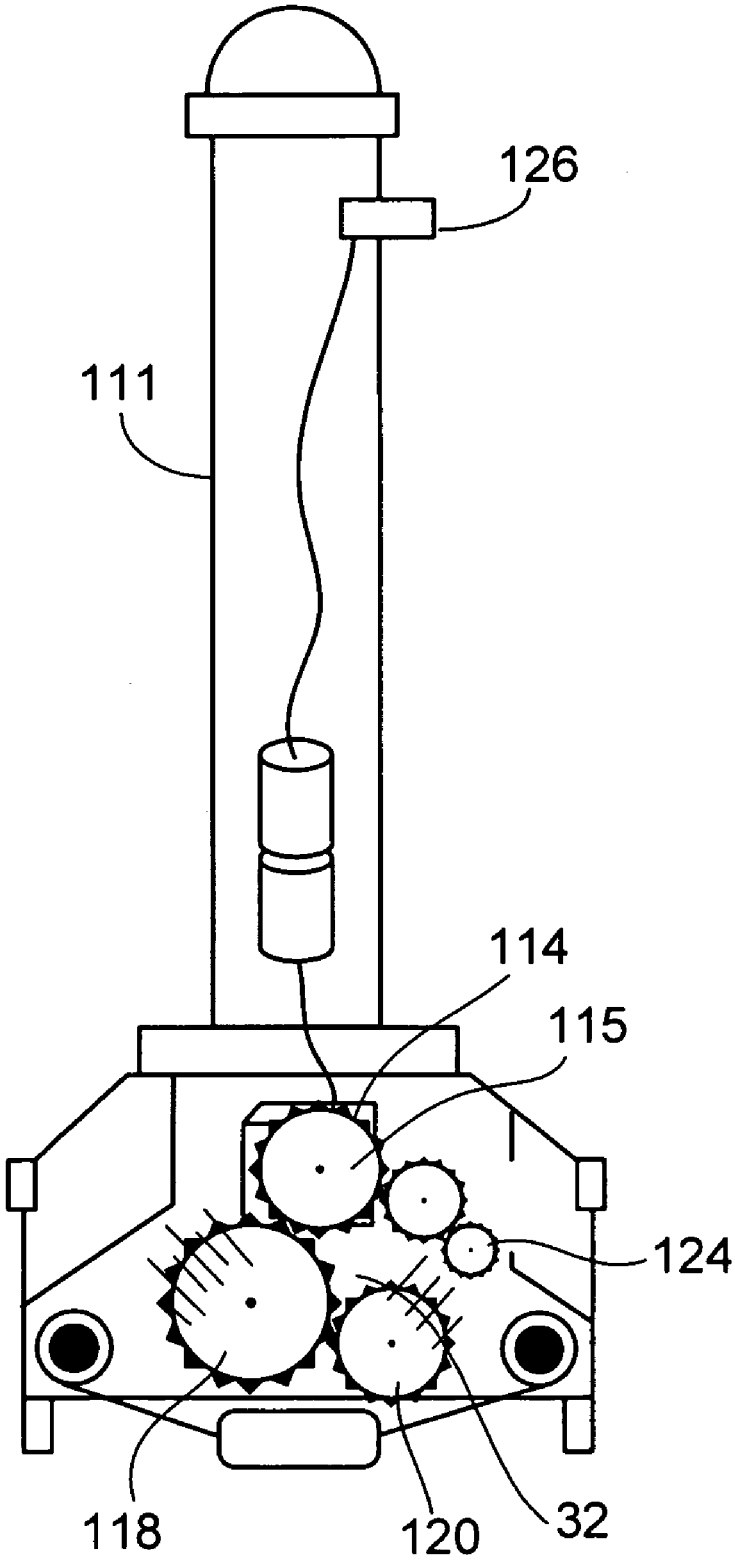
FIG. 7 is a cut-away view of a motorized implementation of the apparatus in its open position.
Figure 8:
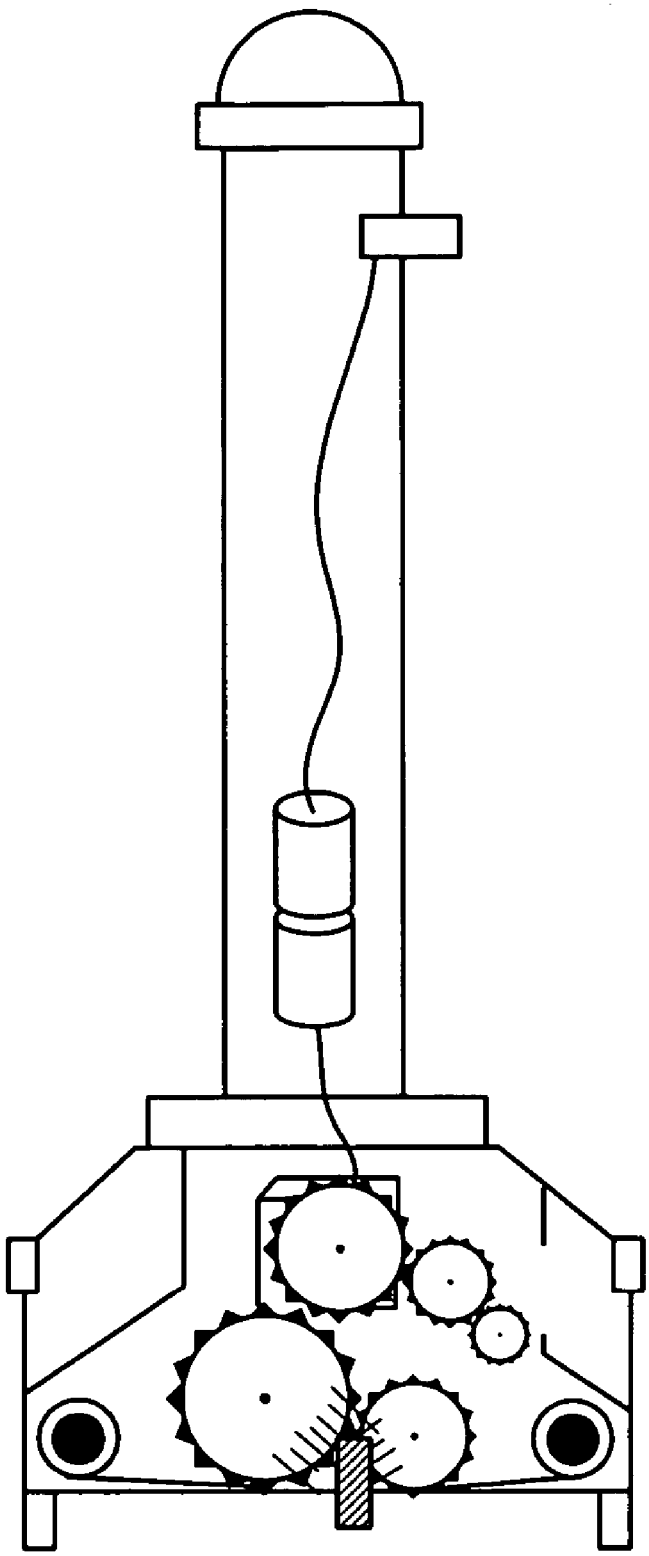
FIG. 8 is a cut-away view of a motorized implementation of the apparatus in its intermediate position.
Figure 9:
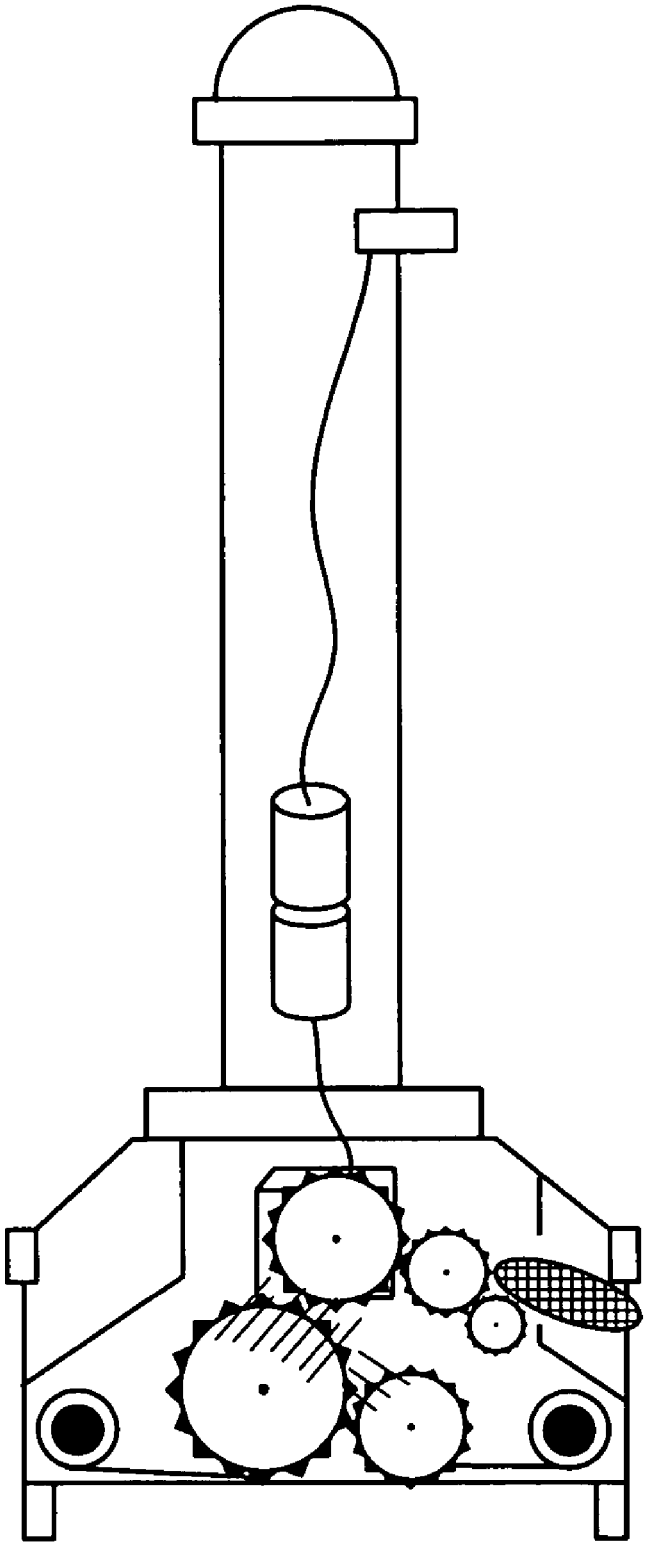
FIG. 9 is a cut-away view of a motorized implementation of the apparatus in its closed position.

FIGS. 7 through 9 illustrate an alternative implementation of the apparatus comprising a handle 111, a housing unit 112, an electric motor 114, a main gear 115 that drives the formation rollers 118 and 120, and guidance rollers 122 and 124. Rather than employing an actuating handle 1 and movement mechanism 9 to drive the formation rollers 5 and 6 as described in the previous implementation of the apparatus, this motorized implementation instead uses a common electrical motor 114 which engages and drives a main gear 115. When the user activates the "On/Off" switch 126 to the "On" position, the main gear 115 turns clockwise, engaging and driving the major formation roller 118, causing it to turn in a counterclockwise direction. The object or waste is then picked up, sealed in a pouch and severed by the formation rollers 118 and 120 in the same fashion as in the implementation described above. In the present implementation, however, the main gear 116 also drives guidance rollers 122 and 124 that are configured in the same fashion as the formation rollers 118 and 120 and which, in lieu of the guidance mechanism 30 of the previous implementation, actively move the sealed pouch 8 into the storage compartment 22. In particular, the main gear 115 engages and causes the guidance roller 122 to turn in a counterclockwise direction, which in turn engages the guidance roller 125, causing it to turn in the opposite, clockwise direction. Of course, a guidance mechanism 30 of the previous implementation could also be employed in this motorized implementation in lieu of the guidance rollers 122 and 124.

The invention claimed is:

1. An apparatus for collecting and permanently sealing an object in a pouch comprising an actuator handle;

a housing unit connected to the actuator handle; wherein the housing unit contains at least one removable material roller for dispensing a material;

a movement mechanism, actuated via the actuator handle, for moving at least one formation roller containing brushes, bridges, and cutting unit to provide a sweeping action for collecting and permanently enveloping of an object in the material dispensed from the at least one material roller to form at least one sealed pouch; and at least one cutting unit for severing the at least one sealed pouch providing it to pass through a guidance mechanism into at least one storage compartment contained in the housing unit.

2. The apparatus of claim 1 wherein the actuator handle further comprises an outer tube and an inner tube.

3. The apparatus of claim 2 wherein the outer tube is cylindrical in shape with a flange at a bottom.

4. The apparatus of claim 3 wherein the outer tube will house a spring utilized to provide resistance for the inner tube as it is depressed.

5. The apparatus of claim 2 wherein the inner tube is cylindrical in shape with a knob at a top of the inner tube and a flange at the bottom.

6. The apparatus of claim 1 wherein the housing unit further comprises at least one accessible storage compartment where the permanently sealed pouch is stared.

7. The apparatus of claim 6 wherein the storage compartment is accessible via a hinged door on the outside of the housing unit.

8. The apparatus of claim 1 wherein the housing unit further comprising a guidance mechanism comprised of an upper and lower ceiling creating a passageway to the storage compartment.

9. The apparatus of claim 1 wherein the housing unit further comprising at least one removable material roller positioned internally to the housing unit.

10. The apparatus of claim 9 wherein the at least one removable material roller will feed the pouch material towards the at least one formation roller.

11. The apparatus of claim 1 wherein the movement mechanism comprised of a rod containing grooves wherein these grooves press against a gear attached to the at least one formation roller and a downward movement of the movement mechanism causes the formation roller to rotate.

12. The apparatus of claim 1 wherein the housing unit comprising the at least one formation roller of cylindrical shape mounted internally will only turn in only one direction when driven by the movement mechanism and as it feeds the sealed collection material towards the guidance mechanism.

13. The apparatus for claim 12 wherein the at least one formation roller further comprising at least one grasping mechanism attached perpendicular to at least one formation roller wherein the grasping mechanism is composed of flaps and brushes to assist with the sweeping and containment of the object being picked up as the at least one formation roller are rotated in opposite directions.

14. The apparatus for claim 12 wherein the formation roller further comprising at least one cavity within the center of the cylindrical shape causing a hollow out shape, allowing the object being picked up and sealed in a pouch, to completely pass through the formation roller without being compressed as the formation roller rotates in opposite directions.

15. The apparatus for claim 12 wherein the formation roller further comprising at least one bridge of a square shape that outlines the cavity on the formation roller wherein the bridges are utilized to compress the pouch material to provide a seal.

16. The apparatus for claim 12 wherein the formation roller further comprising at least one cutting unit mounted perpendicular to the cylinder on the formation roller wherein the cutting unit will consist of an elongated blade wherein each revolution of the formation roller will cause the cutting unit to sever the sealed pouch material releasing it into the storage unit.

* * * * *